United States Patent [19]

Sekiguchi et al.

[11] Patent Number: 4,978,890

[45] Date of Patent: Dec. 18, 1990

[54] FLUORESCENT LAMP DEVICE

[75] Inventors: Hiroshi Sekiguchi, Iruma; Atsushi Sekine, Fuchu; Mitsuaki Ohmiya, Oume, all of Japan

[73] Assignee: Japan Aviation Electronics Industry Limited, Japan

[21] Appl. No.: 362,131

[22] Filed: Jun. 6, 1989

[30] Foreign Application Priority Data

Jul. 4, 1988 [JP] Japan ..... 63-167269

[51] Int. Cl.[5] ..... H01J 7/24; H05B 31/24

[52] U.S. Cl. ..... 315/117; 313/13

[58] Field of Search ..... 315/50, 112, 117; 313/13, 11, 12

[56] References Cited

U.S. PATENT DOCUMENTS 3,330,130 7/1967 Schaith et al. ..... 313/12

3,604,500 9/1971 Davis ..... 313/13

3,974,418 8/1976 Fridrich ..... 315/50

4,518,895 5/1985 Lehman ..... 315/112

FOREIGN PATENT DOCUMENTS 0016461 1/1986 Japan ..... 313/11

*Primary Examiner*—Eugene R. Laroche

*Assistant Examiner*—Son Dinh

[57] ABSTRACT

A fluorescent lamp device which is used for backlighting of a liquid crystal display and in which a Peltier element is thermally coupled with a portion of a fluorescent lamp and a temperature sensor is provided at that portion to be cooled. In accordance with the temperature of the cooled portion detected by the temperature sensor the driving of the Peltier element is controlled so that the temperature of the cooled portion is reduced under a predetermined temperature.

4 Claims, 2 Drawing Sheets

FLUORESCENT LAMP DEVICE

BACKGROUND OF THE INVENTION

The present invention relates to a fluorescent lamp device which is used for backlighting of liquid crystal displays, for example.

In the case of employing a fluorescent lamp as a light source for backlighting of a liquid crystal display, the envelope temperature of the lamp may sometimes exceed an optimum operating temperature owing to an ambient temperature rise and a temperature rise in the display which is caused by heat generation of the lamp itself. FIG. 1 shows how the mercury resonance radiation intensity of the fluorescent lamp varies with temperature variations therein, and in this instance, the optimum operating temperature is about 40° C. As the envelope temperature of the fluorescent lamp becomes higher than the optimum operating temperature, the mercury resonance radiation intensity of the lamp decreases and its brightness lowers accordingly.

To avoid this, it is a general practice in the prior art to provide radiator plates or radiation fins around the fluorescent lamp or to air-cool the lamp by means of a radiation fan so that the envelope temperature of the lamp remains below its optimum operating temperature. Another method that has been proposed is to provide a Peltier element for cooling the fluorescent lamp during its lighting.

However, since the optimum operating temperature of the fluorescent lamp rises as the operating temperature range of the liquid crystal display increases, it is difficult to maintain the envelope temperature of the lamp at the optimum operating temperature at all times through use of the above-mentioned conventional method in which radiator plates or radiation fins are provided around the fluorescent lamp or the lamp is air-cooled by a radiation fan, and the envelope temperature of the lamp may go over its optimum operating temperature, causing decrease in its brightness. With the method which employs a Peltier element for cooling the lamp during its lighting, there are times when the envelope temperature of the fluorescent lamp is held lower than its optimum operating temperature by excessive cooling, resulting in a decrease rather than an increase in the brightness.

SUMMARY OF THE INVENTION

It is therefore an object of the present invention to provide a fluorescent lamp device equipped with simple-structured cooling means which ensures the prevention of a reduction in the brightness by excessive cooling as well as even under high temperature conditions.

According to the present invention, a Peltier element is thermally coupled, as cooling means, with a fluorescent lamp so that the coldest point (a point of the lowest temperature) is provided in a portion of the lamp when the Peltier element is actuated, and a temperature sensor is disposed in association with that portion which becomes colder than any other portion of the lamp when the Peltier element is driven. The actuation of the Peltier element is controlled in accordance with the output of the temperature sensor so that the temperature of the above-mentioned portion remains below a predetermined value.

In the case of providing a reflector for the fluorescent lamp, it can be used also as a radiator plate by disposing it on the hot side of the Peltier element.

As referred to above, the brightness of the fluorescent lamp depends on the envelope temperature, but under high temperature conditions, the brightness is determined by the temperature at the coldest point of the lamp envelope. In the fluorescent lamp device of the present invention which is constructed as mentioned above, since under high temperature conditions the fluorescent lamp is cooled by the Peltier element so that the temperature at the coldest point does not exceed a predetermined value, a reduction in the brightness of the lamp is surely prevented under high temperature conditions. When the temperature at the coldest point has dropped below the predetermined temperature through cooling by the Peltier element, the operation of the Peltier element is stopped or suppressed to avoid further cooling of the lamp, and consequently, there is no possibility of the brightness of the lamp being decreased by excessive cooling.

When the reflector is used also as a radiator plate, there is no need of providing a radiator plate for the Peltier element.

DESCRIPTION OF THE PREFERRED EMBODIMENT

Figure 1:
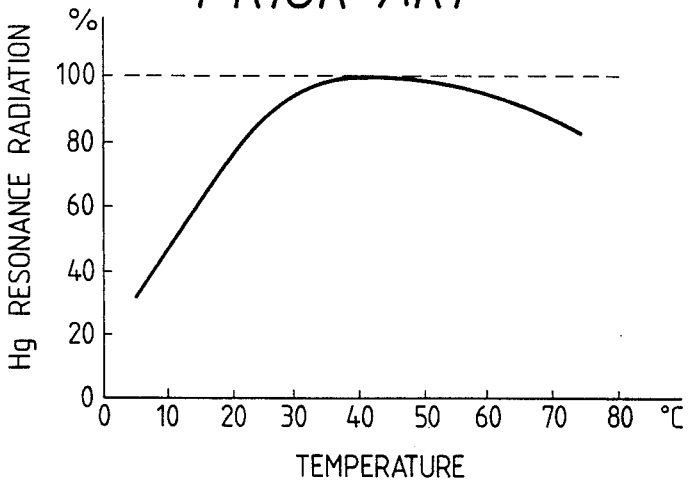
FIG. 1 PRIOR ART
FIG. 1 is a graph showing how the mercury resonance radiation intensity varies with temperature in a fluorescent lamp.
Figure 2:
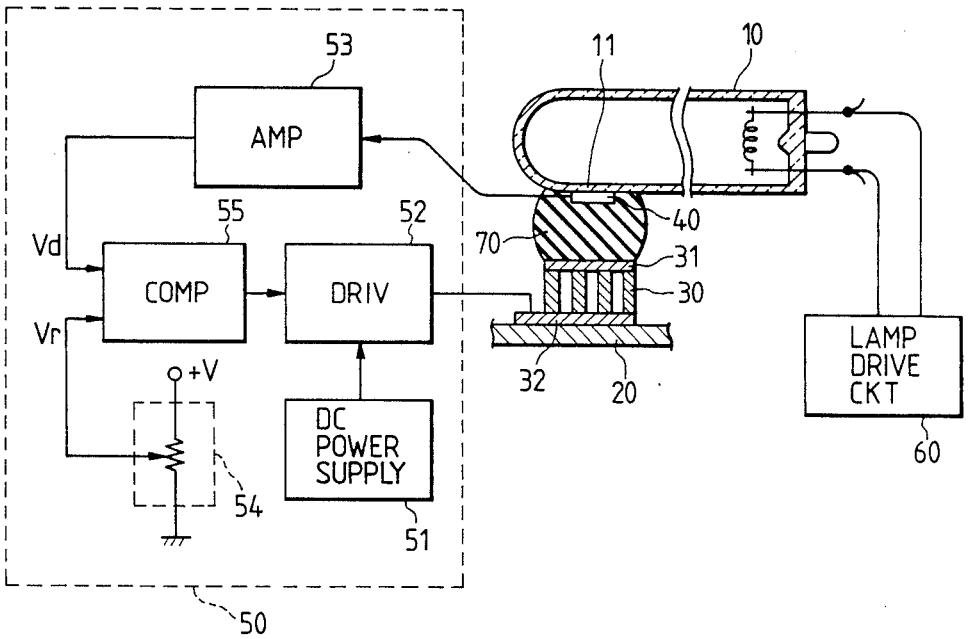
FIG. 2 is a diagram illustrating an embodiment of the fluorescent lamp device of the present invention.

FIG. 2 illustrates an embodiment of the fluorescent lamp device of the present invention, which is provided with a fluorescent lamp 10, a reflector 20, a Peliter element 30, a temperature sensor 40, and a drive control circiut 50.

The flourescent lamp 10 is a U-shaped one in this embodiment and is driven by a lamp drive circuit 60. The reflector 20 is made of a material having a heat radiating effect in this embodiment, and it serves also as a radiator plate and is disposed opposite the fluorescent lamp 10.

The Peltier element 30, which has its cold side 31 attached through a heat conducting compound 70 to the fluorescent lamp 10 at its intermediate portion (between its both leg portions), is thermally coupled with the fluorescent lamp 10, and a hot side 32 of the Peltier element 30 is mounted on the reflector 20. As described later, the Peltier element 30, when driven, cools the fluorescent lamp 10 from the cold side 31, forcibly providing the coldest point in the intermediate portion of the lamp 10.

The temperature sensor 40 is mounted, by the heat conducting compound 70, on the intermediate portion of the fluorescent lamp 10 in contact with or in close proximity to a portion 11 where the coldest point is provided when the Peltier element 30 is driven. The temperature sensor 40 senses the temperature of the portion 11. The temperature sensor 40 is one that yields a current proportional to temperature, for instance, 1 μA per degree of absolute temperature.

The drive control circuit 50 is to control the driving of the Peltier element 30 in accordance with the output of the temperature sensor 40 so that the temperature of the portion 11 of the fluorescent lamp 10 remains lower than a predetermined temperature. The predetermined temperature is set to an optimum operating temperature of the flourescent lamp 10 or a temperature in the vicinity thereof, for example, 40° C.

In this embodiment the drive control circuit 50 comprises: a DC power supply 51 which provides a DC voltage of, for example, 15 V; a driver 52 which converts the DC voltage from the DC power supply 51 into a DC voltage of, for instance, 2.5 V. suitable for application to the Peltier element 30 and applies thereto the converted DC voltage; an amplifier 53 which converts the output current of the temperature sensor 40 into a voltage; a reference voltage generator 54 which yields a reference voltage corresponding to the afore-mentioned predetermined temperature, that is, a reference voltage Vr equal to a detected voltage Vd which is provided from the amplifier 53 when the temperature of the portion 11 of the fluorescent lamp 10 is at the predetermined temperature; and a comparator 55 which compares the detected voltage Vd and the reference voltage Vr and permits or inhibits a supply of the above-said DC voltage Vr and permits or inhibits a supply of the above-said DC voltage from the driver 52 to the Peltier element 30, depending on whether the detected voltage Vd is higher or lower than the reference voltage Vr.

In the fluorescent lamp device described above, when the temperature of the portion 11 of the lamp 10 is lower than the afore-mentioned predetermined temperature partly because ambient temperature is low and partly because the amount of heat generated by the lamp 10 itself is small as at the start of its lighting, the detected voltage Vd is lower than the reference voltage Vr and the Peltier element 30 is not driven for cooling the lamp 10. When the temperature of the portion 11 of the lamp 10 exceeds the predetermined temperature owing to high ambient temperature coupled with heat generation by the lamp 10 itself, the detected voltage Vd becomes higher than the reference voltage Vr and the Peltier element 30 is driven for cooling the lamp 10, by which the portion 11 of the lamp 10 becomes colder than any other portions thereof, allowing the temperature of that portion 11 to drop below the predetermined temperature. Accordingly, the brightness of the flourescent lamp 10 will not be reduced even under high temperature conditions.

Figure 3:
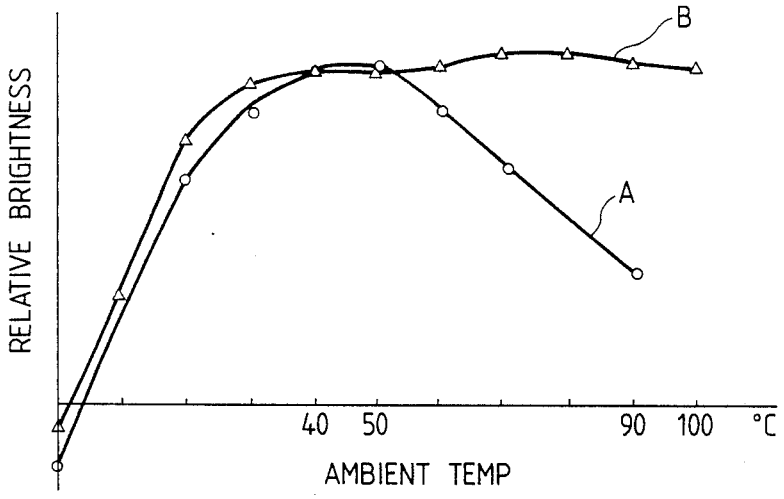
FIG. 3 is a graph showing the relationship between the brightness of a fluorescent lamp and ambient temperature in the fluorescent lamp device of the present invention, in comparison with the same relationship in a conventional lamp device.

The curve A in FIG. 3 shows a plot of measured values of brightness variations of a fluorescent lamp against ambient temperature changes in a conventional fluorescent lamp device with no function of such temperature control as described above. In this instance, as ambient temperature goes over about 40° C., the brightness of the lamp decreases as referred to previously. In contrast thereto, according to the above-described embodiment of the flourescent lamp device which performs temperature control by the combined use of the Peltier element 30, the temperature sensor 40 and the drive control circuit 50, the brightness of the lamp 10 does not decreases even if ambient temperature is 100° C. as indicated by the curve B in FIG. 3 which shows a plot of measured values of brightness variations of the lamp 10 against ambient temperature changes when the afore-mentioned predetermined temperature was 40° C.

Furthermore, in the fluorescent lamp device of the above embodiment, when the temperature of the portion 11 of the lamp 10 has dropped below the predetermined temperature as the result of cooling by the Peltier element 30, the detected voltage Vd falls lower than the reference voltage Vr, stopping the driving of the Peltier element 30 to prohibit it from cooling of the lamp 10. Accordingly, the brightness of the lamp 10 will not be reduced, either, by its excessive cooling.

Where the reflector 20 is disposed on the hot side 32 of the Peltier element 30 and is used also as a radiator plate as shown in FIG. 2, no particular radiator plate needs to be provided for the Peltier element 30, and consequently, the fluorescent lamp device can be made less expensive.

The drive control circuit 50 in the illustrated embodiment performs ON-OFF drive control which permits or inhibits driving of the Peltier element 30, depending on whether the temperature of the portion 11 of the fluorescent lamp 10 detected by the temperature sensor 40 is higher or lower than the predetermined temperature. It is also possible, however, to employ a circuit arrangement for linear drive control which changes the drive voltage of the Peltier element 30 in accordance with the difference between the temperature of the portion 11 and the predetermined temperature, thereby changing the degree of cooling of the fluorescent lamp 10 by the Peltier element 30. This also produces the effect mentioned above.

Moreover, the present invention is also applicable to a fluorescent lamp device which uses a straight fluorescent lamp, though not shown.

As described above, the present invention ensures the prevention of lowering of the lamp brightness by excessive cooling as well as under high temperature conditions. In addition, according to the present invention, temperature is detected at the portion of the fluorescent lamp where the coldest point is provided when the Peltier element is driven, and the driving of the Peltier element is controlled so that the temperature at the portion of the coldest point falls lower than the predetermined temperature. This permits simplification of the drive control circuit and eliminates the possibility of introducing a time lag in control as in the case of control which involves the necessity of detecting ambient temperature. For the same reasons as mentioned above, no complicated calculations for heat transmission paths or the like are needed, and hence the drive control circuit can be designed with ease. Moreover, the fluorescent lamp device of the present invention does not cause an increase in lamp power under high temperature conditions, that is, consumes less power, and also prevents the service life of the fluorescent lamp from being shortened by brightness variations under high temperature conditions.

By disposing the reflector on the hot side of the Peltier element so that it serves also as a radiator plate, the manufacturing costs of the fluorescent lamp device can be lowered because no particular radiator plate is needed for the Peltier element.

It will be apparent that many modifications and variations may be effected without departing from the scope of the novel concepts of the present invention.

What is claimed is:

1. A fluorescent lamp device comprising:

a fluorescent lamp;

a Peltier element thermally coupled with said fluorescent lamp on the cold side thereof, for forcibly providing the coldest point in a portion of said fluorescent lamp;

a temperature sensor disposed adjacent said fluorescent lamp at said portion where said coldest point is provided, for detecting the temperature of said portion; and a drive control circuit for controlling the driving of said Peltier element so that the temperature of said portion where said coldest point is provided becomes lower than a predetermined temperature.

2. The fluorescent lamp device of claim 1, wherein a reflector serving also as a radiator plate is provided on the hot side of said Peltier element.

3. The fluorescent lamp device of claim 1 or 2, wherein a heat conducting compound is interposed between said fluorescent lamp and said cold side of said Peltier element.

4. The fluorescent lamp device of claim 3, wherein said temperature sensor is buried in said heat conducting compound.

* * * * *